United States Patent [19]

Spencer

[11] Patent Number: 5,016,553

[45] Date of Patent: May 21, 1991

[54] VECTOR STEERING CONTROL SYSTEM

[76] Inventor: William P. Spencer, 6252 Chesshire La. N., Maple Grove, Minn. 55369

[21] Appl. No.: 445,361

[22] Filed: Dec. 4, 1989

[51] Int. Cl.[5] ..... B63H 25/46

[52] U.S. Cl. ..... 114/151; 440/5; 440/40; 440/42; 440/51; 440/62

[58] Field of Search ..... 114/151, 147, 148; 440/5, 40, 42, 43, 67, 51, 62

[56] References Cited

U.S. PATENT DOCUMENTS 4,200,055 4/1980 Siegel ..... 440/5
4,208,978 6/1980 Eller ..... 114/151

FOREIGN PATENT DOCUMENTS 268594 11/1986 Japan ..... 114/151

*Primary Examiner*—Sherman Basinger

[57] ABSTRACT

The device comprises a thruster assembly which consists of a housing, thruster motor, thruster propeller, and thruster motor control device. When integrated into a stern mounted main drive, the thruster housing becomes integral with the main drive. The thruster is situated on the transom just above the bottom line of the hull with its axis in line with the transom, horizontal with the water line, and at right angles to the main drive. The thruster control device is connected to the boat's steering wheel linkage so that when the wheel is turned the thruster is activated. Turning the steering wheel causes the thruster to push the boat's stern at right angles to the main drive thus causing the boat to turn. The direction the wheel is turned determines the direction of thrust (right or left) and therefore, the direction the boat turns. Additionally, thruster control can be achieved by connecting the thruster control device to the throttle/shift lever. Mounting this lever from side to side would activate the thruster causing the boat to turn in the desired direction.

8 Claims, 2 Drawing Sheets

VECTOR STEERING CONTROL SYSTEM

BACKGROUND OF THE INVENTION

This invention will provide a unique solution to problems faced by operators of many power boats and sail boats. The problems have to do with low speed steering control. Most boats have good steering control when moving forward at moderate or higher speeds. However, as speed is decreased as it is in many channels, marinas, around landings, launch ramps, and in crowded areas, steering control is dramatically reduced. Wind and currents add further to low speed steering difficulties. When boats are at rest, control becomes much worse to nonexistent.

In the past, most boats used rudders to provide steering control. Even today, many power boats and all sail boats continue to depend on rudders even though they are subject to the difficulties discussed above. Steering control was improved with steerable drives such as outboard engines and inboard/outdrives. With these systems, the propellers can be physically turned providing thrust to steer the boat as well as to drive it forward (or backward). These devices are a big improvement over rudders, but continue to have serious limitations. They can only be turned about 45° in either direction from straight ahead. This works pretty well at moderate forward speeds, but provides poor control when backing or when the boat is at rest. Wind and currents can further reduce controllability; in many cases substantially. To make matters worse, many outboard engines and most inboard/outdrives can be trimmed up. This allows the propeller to be raised for safer operation in shallow water. When trimmed up, the propeller is rotated up to approximately the level of the bottom of the boat. When in this raised position it is at about a 45° angle to the surface of the water (it's approximately parallel to the water surface when in a normal operating position). Half the propellers thrust in forward or backward, but the other half is either up or down providing no motion control. Driven in a trimmed up position provides very poor steering control forward and even worse control in reverse.

Boats having either rudders or turnable drives as most are presently equipped, will encounter many situations where steering control is very difficult, requiring considerable anticipation, presence of mind and skill. The object of this invention is to provide substantially improved low speed steering control that overcomes the limitations of conventional water craft steering systems.

Additionally an important object of the invention is to accomplish superior low speed steering control without introducing complicated operator's controls.

SUMMARY OF THE INVENTION

The above mentioned objectives are met by the invention by providing a unique new steering control system. This new steering control system separates high speed steering from low speed steering and provides separate highly effective steering devices for each speed range. These devices are the same as or similar to existing devices, but are used together rather than separately. They consist of a rudder or jet drive nozzle and a thruster. The rudder is used for forward control from moderate to maximum speed. The thruster is used for steering control at slow forward speeds, in reverse, and when the boat is at rest. Both rudder and thruster are controlled by the boat's steering wheel or throttle/shift control lever and both can be integrated into the main drive or mounted separately.

The rudder is controlled by conventional mechanical linkage connected to the boat's steering wheel. The thruster is a propulsion device such as a propeller or small jet drive mounted parallel to the boat's transom and at right angles to the main drive. When activated it provides thrust laterally which causes the boat's stern to be pushed either right or left as desired, which causes the boat to turn. Since boats are steered from their sterns, these are completely natural reactions to steering inputs from the boat's operator. The thruster is controlled by input from the boat's steering wheel or throttle/shift lever and allows the operator to control thruster steering by simply turning the boat's steering wheel or by moving the throttle/shift lever right or left.

The thruster can be powered a number of ways including hydraulically, electrically, or mechanically. A hydraulic system would employ an engine driven pump powering a hydraulic motor which turns the thruster propeller. Steering inputs would come from the boat's steering cable connected to a control valve. When the steering device is activated right, the valve would direct hydraulic fluid to one side of the hydraulic thruster motor causing it to turn the thruster propeller to provide thrust to the boat's stern causing the boat to turn right. Activating the steering device left would reverse the fluid direction causing the boat to turn left. When the steering device is in the straight ahead position, no thrust would be provided. Steering force would be variable from 0 to 100% depending on how fully the steering device is activated. Electrically or mechanically driven thrusters would have similar controls appropriate for those systems.

The thruster, regardless of power source, can be operated independently of the main drive. Therefore, positioning of the boat's stern (steering) can be achieved regardless of whether the main drive is in gear (forward or reverse). Simply activating the steering device in the appropriate direction would cause the boat's stern to be positioned (steered) as desired. Since the thruster is in line with the transom, it does not provide any forward or backward motion as other steering drives do. Forward or backward motion is achieved by engaging the main drive. This allows any combination of forward, reverse or steering in either direction, at the operator's discretion and does not impose forward or backward motion as a limitation of the steering control system.

Thruster steering will provide far superior steering control compared to turnable drives or rudders without adding significant complexity to the operator's controls. The same steering wheel and forward/reverse shift lever as currently provided are the only controls needed.

Thruster steering technology can be used with any of the currently available drive systems. Boats using rudder steering systems could have steering thrusters added. Inboard/outdrives could be redesigned to incorporate integral steering thrusters and to eliminate the complex apparatus used to turn them including power steering. Jet drives could also incorporate steering thrusters as integral components.

BRIEF DESCRIPTION OF THE DRAWINGS

The invention will be more easily understood by reading the following descriptions and referring to the drawings.

Figure 1:
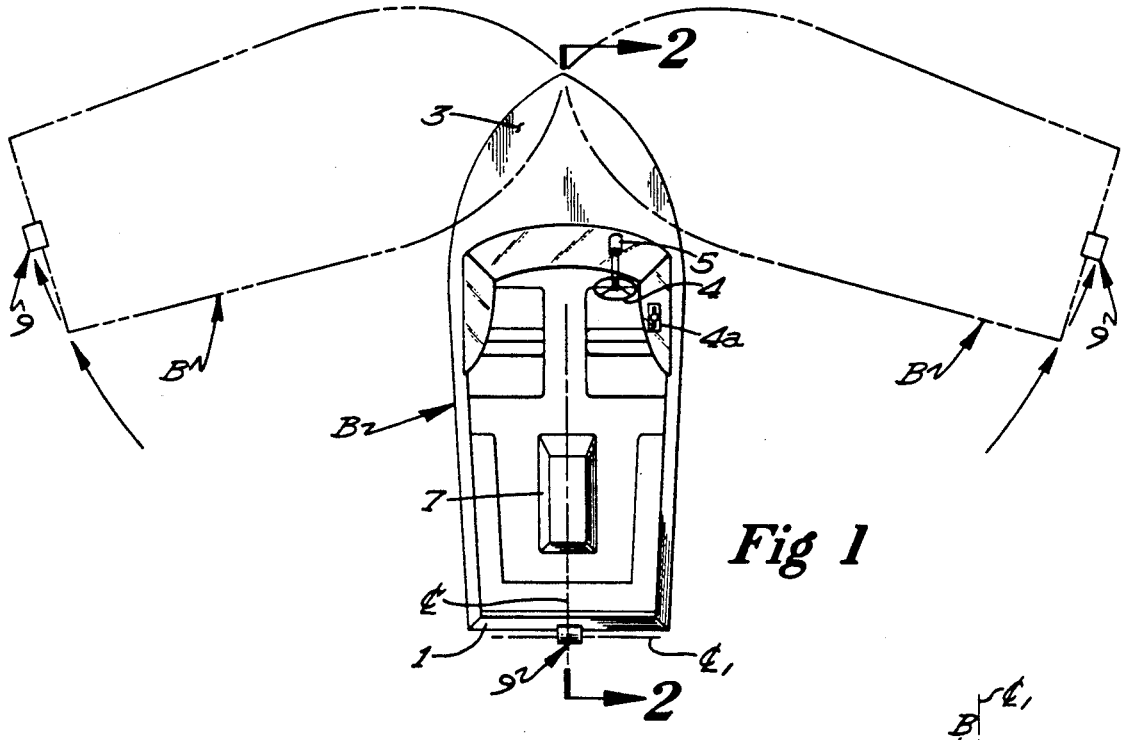
FIG. 1—shows an overhead view of a typical small power boat with reference to major components.

Following is a listing of major components shown in the drawings.

Transom 1
Bottom of Hull 2
Deck 3
Steering Wheel 4
Combined Throttle/Shift Lever 4A
Steering Gear 5
Steering Cable 6
Main Engine 7
Engine Coupling 8
Thruster Assembly 9
Thruster Motor 10
Thruster Propeller 11
Hydraulic Pump 12
Hydraulic Control Device 13
Hydraulic Oil Lines 14
Main Propeller 15
Rudder 16
Jet Drive Propeller 17
Jet Drive Steering Nozzle 18
Jet Drive Water Intake 19
Inboard/Outdrive 20
Surface Piercing Inboard/Outdrive 21
Jet Drive 22

DESCRIPTION OF A PREFERRED EMBODIMENT

The invention relates to a thruster steering device that when activated provides steering control for water craft. The thruster is a device that pushes the boat's hull in a desired direction to achieve steering. The thruster in this invention would be mounted on the boat's transom (stern) and could be integrated into a stern mounted main drive or attached separately. The thruster is used for low speed steering control in conjunction with a high speed steering device such as a rudder or jet drive nozzle. The thruster can obtain its power from the main engine, or when mounted separately from an auxiliary power source. Power transmission from the main engine or auxiliary power source to the thruster motor can be any practical method such as electric, mechanical, pneumatic, or hydraulic.

Figure 3:
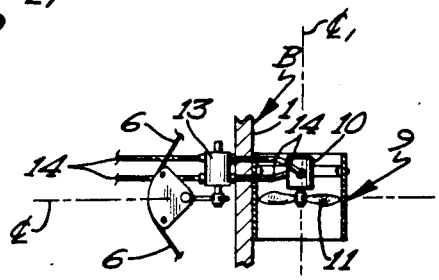
FIG. 3—shows an overhead view of a typical thruster steering control device with reference to major components.
Figure 2:
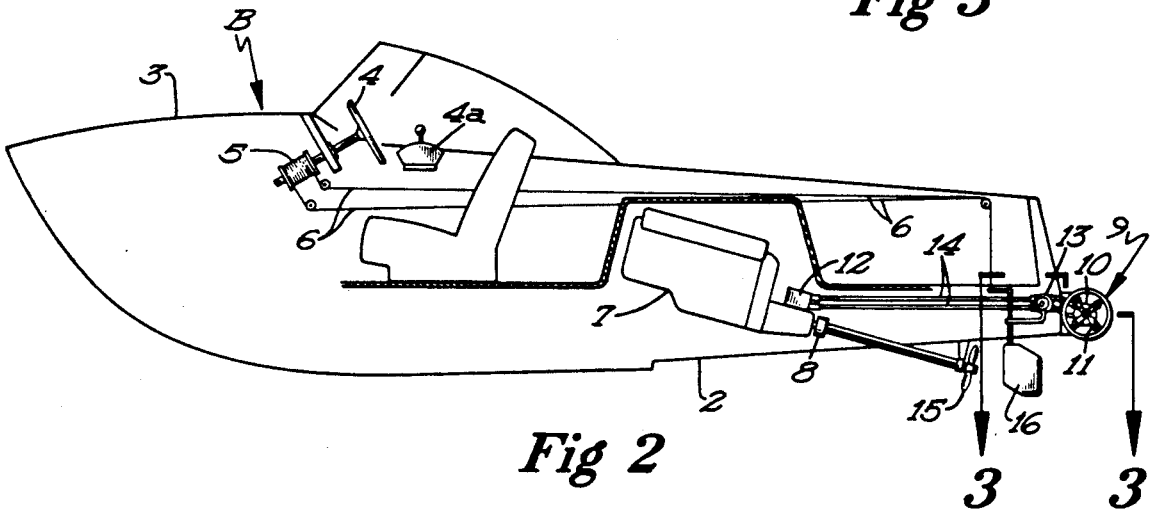
FIG. 2—shows a general layout of a conventional inboard boat with modifications to include a thruster steering control system.
Figure 4:
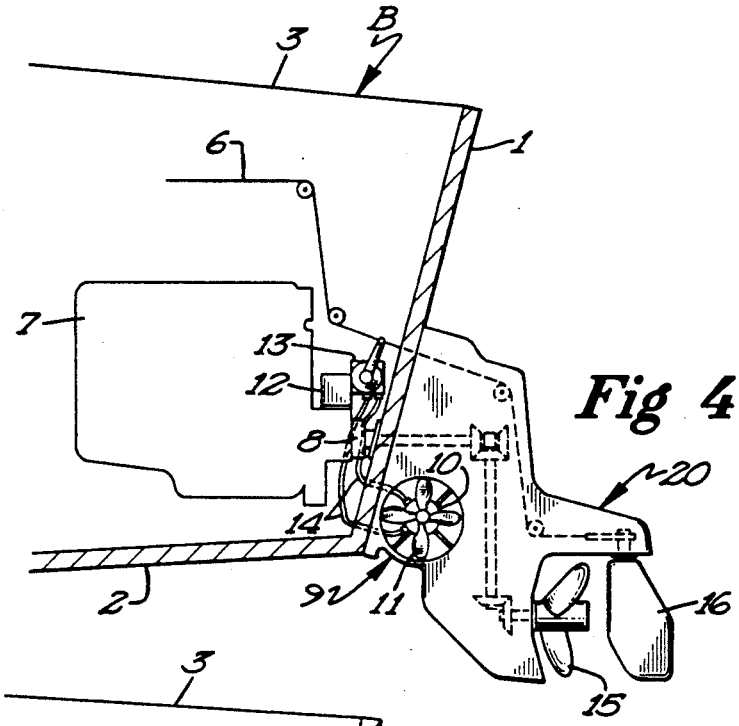
FIG. 4—shows an inboard/outdrive arrangement modified to include a thruster steering control system.
Figure 5:
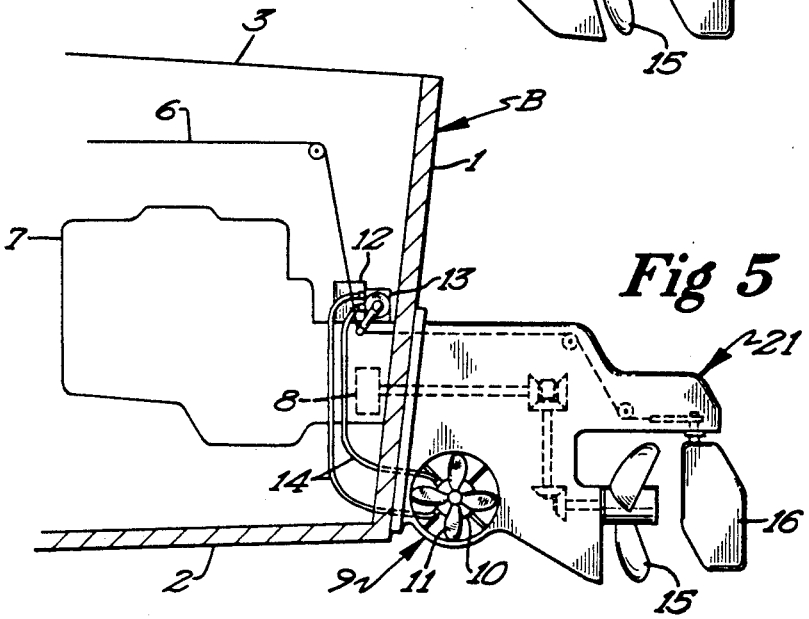
FIG. 5—shows an inboard/outdrive modified to provide surface piercing propeller technology and thruster steering control.
Figure 6:
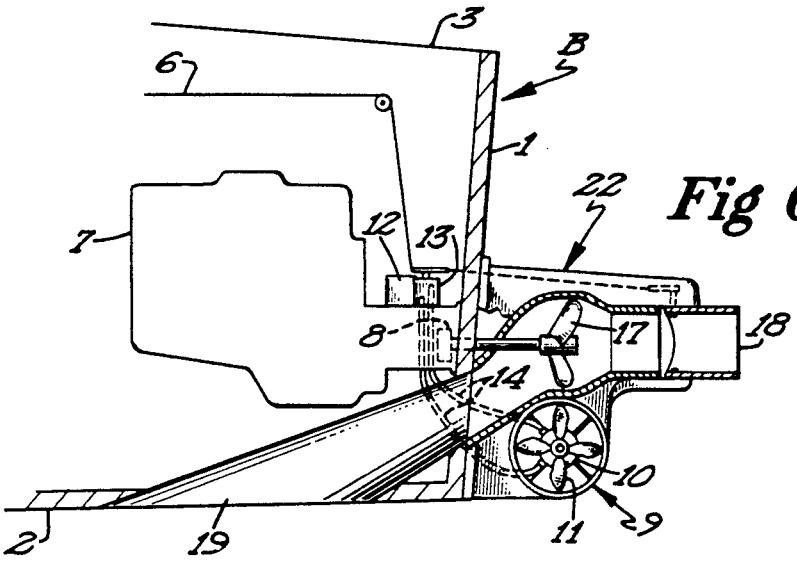
FIG. 6—shows a thruster steering control system added to a jet drive.

Referring now in more detail to the drawings, FIGS. 1, 2, 3, 4, 5, and 6. FIG. 1 shows a typical small power boat arrangement. FIG. 2 shows a typical inboard power boat arrangement. FIG. 3 shows a typical thruster steering control device. FIG. 4 shows a typical inboard/outdrive arrangement. FIG. 5 shows a surface piercing adaptation of an inboard/outdrive, and FIG. 6 shows a typical jet drive arrangement. Each of the four drive arrangements, FIGS. 2, 4, 5, and 6 show how a thruster steering control device could be added. The thruster steering device in these examples uses a hydraulic power source derived from the main engine. The thruster steering control system consists of an engine driven hydraulic pump (12), hydraulic control, device (13), hydraulic oil lines (14), thruster assembly (9), thruster motor (10), and thruster propeller (11). The main engine (7) drives the hydraulic pump (12) which supplies hydraulic power to the thruster motor (10) through hydraulic lines (14). Hydraulic power is controlled by the hydraulic control device (13) which is activated by the steering cable (6). Two steering devices are possible utilizing the same controls normally found on power boats, the steering wheel (4) and the throttle/shift lever (**4*a*). Vector steering can use either of these devices individually or together which would allow the boat operator a choice of steering means. If a boat were equipped with both devices rigged to include steering capability, only one device would be used at a time at the operators discretion and their operation would be same as described below. The steering wheel (4) activates a conventional steering cable connected to a rudder for forward steering control from moderate to full speed. For low speed forward, while at rest as next to a dock, or in reverse, thruster steering is utilized. The steering cable (6) which connects the steering wheel (4) and rudder (16) is also mechanically linked to a hydraulic control device (13). When the steering wheel (4) is used to control the thruster, as the wheel is turned and turns the rudder, being mechanically linked to the hydraulic control device (13) it also activates this device. The hydraulic control device (13) is a valve which can provide hydraulic power flow in either of two directions and which has a centered neutral position where no power is transmitted. Typically such a hydraulic control device (13) would have a lever connected to a rotary or linear valve with a center position. The lever would be connected to the steering cable (6). When in the center position, no hydraulic oil would be allowed to flow. When the lever is moved by the steering cable (6) from the center position, it would open the valve and allow oil to flow in one direction to provide steering in the desired direction via the thruster motor (10). When the lever is moved by the steering cable (6) in the opposite direction from the center position, hydraulic oil would be directed to flow in the opposite direction thus reversing the thruster motor (10) direction and providing steering in the opposite direction. With a conventional power boat, when the throttle/shift lever is moved forward it engages the forward gearing and increases throttle position as it advances forward. When moved backward from a central neutral position, it engages the reverse gearing, and increases throttle setting as it continues to move farther back. When used to control thruster steering, this lever would be moved to the right to turn the boat right and it would be moved to the left to turn the boat left. Forward and backward motion of this lever would therefore activate the shift and throttle cables. In this configuration the lever would be called a combined throttle/shift and steering lever (4*a*). When the steering device (4) or (4*a*) is activated to effect a right turn, it causes the hydrualic control device (13) to direct hydraulic power to the thruster motor (10**) which turns the thruster propeller

(11) in the appropriate direction to push the boat's stern to the left. This causes the boat to turn right. When the steering device (4) or (4a) is activated to effect a left turn, the power to the thruster motor (10) is reversed by the hydraulic control device (13) and the boat turns left. The more the steering device (4) or (4a) is activated, the greater the power flow to the thruster motor (10) with the greatest thrust occurring when the steering device (4) or (4a) is fully activated in the appropriate direction. This allows the boat's operator to provide low speed steering control from 0 to maximum thrust simply by activating the boat's steering device (4) or (4a).

The thruster steering control system can be operated independently of the main drive. Therefore, the operator can use thruster steering alone, forward gear alone, reverse gear alone, or any combination. This will provide superior steering control to any of the conventional systems mentioned previously.

Referring now to the specific figures in the drawings. FIG. 1 shows an overhead view of a typical small power boat and its general arrangement including its transom (1), deck (3), steering wheel (4), throttle/shift lever (4A), steering gear (5), main engine (7), and thruster assembly (9).

FIG. 2 shows a typical inboard main drive arrangement with a thruster assembly (9) mounted on the transom (1). The hydraulic pump (12) is mounted on and driven by the main engine (7). Hydraulic power is delivered to the thruster motor (10) by hydraulic oil lines (14) and controlled by a hydraulic control device (13) that is activated by a steering cable (6). The steering cable (6) is also connected to the rudder (16) for high speed control. At planing speeds, the thruster assembly (9) is above the water line and not used. Steering is accomplished by turning the rudder (16). At slow speeds with the boat off plane, the thruster (9) provides steering control.

FIG. 3 shows an overhead view of a typical thruster assembly. The thruster assembly (9) is attached to a transom (1). Hydraulic power is delivered from the main engine through hydraulic oil lines (14) to a hydraulic control device (13). The hydraulic control device (13) is actuated by the steering cable (6). Steering inputs from the boat's operator through the steering cable (6) to the hydraulic control device (13) regulate the amount of oil and its direction of flow, thus regulating power supplied to the hydraulic motor (10). The hydrualic motor (10) turns in either direction as determined by the hydraulic oil flow through it. Attached to the thruster motor (10) shaft is the thruster propeller. As power is supplied to the thruster motor (10), it causes the thruster propeller (11) to turn in the direction indicated by the oil flow. The thruster motor and propeller are contained within a cylindrical housing (9).

FIG. 4 shows a typical inboard/outdrive (20) arrangement modified to incorporate a thruster (9) assembly and rudder (16). In this arrangement it is unnecessary for the outdrive unit (20) to turn side to side to provide steering control and thus for many such drives power steering would be eliminted. Steering control is accomplished in the same manner as the inboard arrangement in FIG. 1 with the thruster assembly (9) providing low speed steering control and the rudder (16) providing high speed steering control. In this arrangement however, the thruster assembly (9), hydraulic pump (12), hydraulic control device (13) and hydraulic oil lines (14) are all integrated into the main drive unit (20).

FIG. 5 shows how an inboard/outdrive unit could be modified to provide a surface piercing drive (21). Its steering control system and general layout are the same as the inboard/outdrive system (20). The surface piercing inboard/outdrive arrangement is also an integrated system with hydraulic pump (12), hydraulic oil lines (14), hydraulic control device (13), and thruster assembly (9) included as components of the main drive.

FIG. 6 shows a typical jet drive (22) arrangement modified to include a thruster steering control system. Low speed steering control is accomplished in the same manner as the other three drives using the thruster steering control system. However, with a jet drive, high speed steering control is accomplished by turning the jet nozzle (18) from side to side. Rudders are not used. In a jet drive system the steering cable (6) connects to the hydraulic control device (13) and the steering nozzle (18). The jet drive (22) arrangement is also an integrated design with hydraulic pump (12), hydraulic control (13), hydraulic oil lines (14) and thruster assembly (9) all included as components of the main drive.

What is claimed is:

1. In combination with a small boat having a hull, including a transom at its stern, said boat hull having a longitudinal center line, an engine having water engaging propulsion means, high speed steering means positioned in the water and pivotally connected to said boat, and operator means operably connected to said high speed steering means and being operable for shifting the high speed steering means for high speed steering of the boat, a low speed vector steering assembly for low speed steering of the boat comprising a rotary thruster assembly mounted on said boat exteriorly of the boat transom below the water surface, a reversible rotary motor having an output shaft and having a propeller mounted on said shaft, the axis of rotation of said motor propeller being arranged at right angles to the longitudinal center line of the boat hull, and adjustable control means operatively connected to said motor and being selectively adjustable between right turning, left turning, and neutral positions, said control means, when in the right turning position, causing the motor propeller to rotate in one direction and, when in the left turning position, causing the motor propeller to rotate in the opposite direction whereby the stern of the boat will be shifted laterally in one direction or the other when the rotary motor is operated in the right turning or left turning directions, and means interconnecting the control means to said operator means of the boat for shifting the control means between right turning, left turning, and neutral positions.

2. In combination with a small boat having a hull, including a transom at its stern, said boat hull having a longitudinal center line, an engine having water engaging propulsion means, high speed steering means positioned in the water and pivotally connected to said boat, and operator means operably connected to said high speed steering means and being operable for shifting the high speed steering means for high speed steering of the boat, a low speed vector steering assembly for low speed steering of the boat comprising a rotary thrust assembly mounted on said boat exteriorly of the boat transom below the water surface, a reversible rotary hydraulic motor having an output shaft and having a propeller mounted on said shaft, the axis of rotation of said motor propeller being arranged at right angles to the longitudinal center line of the boat hull, a pump connected to a source of hydraulic fluid, and an adjustable control valve in communicating relation with said pump and said hydraulic motor, said valve being selectively adjustable between right turning, left turning, and neutral positions, said valve, when in the right turning position, causing the motor propeller to rotate in one direction and, when in the left turning position, causing the motor propeller to rotate in the opposite direction whereby the stern of the boat will be shifted laterally in one direction or the other when the rotary motor is operated in the right turning or left turning directions, and means interconnecting the control valve to said operator means of the boat for shifting the control valve between right turning, left turning, and neutral positions.

3. In combination with a small boat having a hull including a transom at its stern, said boat hull having a longitudinal center line, an engine having a water engaging propulsion means, a steering wheel mounted in said boat and being rotatable in opposite directions, and high speed steering means positioned in the water and pivotally connected to the boat and being operably connected with the steering wheel for high speed steering of the boat, a low speed steering assembly for low speed steering of the boat comprising a rotary thrust assembly mounted on said boat exteriorly of the boat transom below the water surface, a reversible rotary hydraulic motor having an output shaft and having a propeller mounted on said shaft, the axis of rotation of said motor propeller being arranged at right angles to the longitudinal center line of the boat hull, a pump connected to a source of hydraulic fluid, an adjustable control valve in communicating relation with said pump and said hydraulic motor, said valve being selectively adjustable between right turning, left turning, and neutral positions, said valve, when in the right turning position, causing the motor propeller to rotate in one direction, and, when in the left turning position, causing the motor propeller to rotate in the opposite direction whereby the stern of the boat will be shifted in a right turning or left turning direction, and actuating means connecting the control valve to the steering wheel of the boat for shifting the control valve between right turning, left turning, and neutral positions.

4. The invention as defined in claim 3 and means interconnecting the pump with the boat engine and wherein the pump is driven by the boat engine.

5. The invention as defined in claim 3 wherein the adjustable high speed steering means comprises a rudder extending into the water and being pivotally shiftable in response to rotation of the steering wheel.

6. The invention as defined in claim 1 wherein the boat engine comprises a water jet engine having a jet nozzle through which water is impelled to propel the boat, said nozzle being mounted on the boat for pivotal movement relative thereto to cause high speed steering of the boat.

7. The invention as defined in claim 1 wherein the boat engine comprises an inboard engine and the high speed steering means comprises a vertically disposed rudder.

8. The invention as defined in claim 3 and means defining a cylindrical chamber, and said rotary motor being positioned interiorly of said chamber.

* * * * *